US010563368B2

(12) United States Patent
Ley, III

(10) Patent No.: US 10,563,368 B2
(45) Date of Patent: Feb. 18, 2020

(54) PUMPING SYSTEM FOR BODIES OF WATER

(71) Applicant: George E. Ley, III, Glenmoore, PA (US)

(72) Inventor: George E. Ley, III, Glenmoore, PA (US)

( * ) Notice: Subject to any disclaimer, the term of this patent is extended or adjusted under 35 U.S.C. 154(b) by 13 days.

(21) Appl. No.: 15/056,073

(22) Filed: Feb. 29, 2016

(65) Prior Publication Data

US 2017/0247849 A1 Aug. 31, 2017

(51) Int. Cl.
*E02B 11/00* (2006.01)

(52) U.S. Cl.
CPC ..... *E02B 11/00* (2013.01)

(58) Field of Classification Search
CPC ... C02F 1/00; E02B 11/00; E03B 3/00; E03B 3/04
USPC ..... 405/127
See application file for complete search history.

(56) References Cited

U.S. PATENT DOCUMENTS 2,597,728 A * 5/1952 Hink ..... A62C 25/005 210/119
3,799,690 A * 3/1974 Klaas ..... F04D 3/005 415/121.2
4,662,782 A * 5/1987 Lambert ..... A01K 29/00 405/108
5,052,855 A * 10/1991 Chapman ..... A01G 25/00 210/242.1
7,565,932 B2 * 7/2009 Lawson ..... F04B 47/06 166/105
7,975,769 B2 * 7/2011 Pollack ..... B63B 21/502 114/230.1
8,523,984 B2 * 9/2013 Simnioniw ..... B01F 3/04248 210/170.05
8,740,586 B2 * 6/2014 Martinez ..... F04D 13/10 166/62

* cited by examiner

*Primary Examiner* — Craig M Schneider
*Assistant Examiner* — Angelisa L. Hicks
(74) *Attorney, Agent, or Firm* — Dunlap Bennett & Ludwig PLLC

(57) ABSTRACT

A pumping system is provided. The pumping system includes at least one elongated tubing. The elongated tubing includes a first end forming an entrance and a second end forming an exit. A pump discharge tubing is disposed within the elongated tubing and runs from the first end to the second end of the elongated tubing. A pump is coupled to the pump discharge tubing and is operable to pump liquids through the pump discharge tubing. A seal plate is releasably secured to a flange formed at the exit of the elongated tubing. The pump discharge tubing snuggly runs through an opening formed through the seal plate and releasably secures to a manifold.

7 Claims, 3 Drawing Sheets

PUMPING SYSTEM FOR BODIES OF WATER

BACKGROUND OF THE INVENTION

The present invention relates to pumps and, more particularly, to a pumping system for bodies of water.

Pumping stations are facilities including pumps and equipment for pumping fluids from one place to another. They are used for a variety of infrastructure systems, such as the supply of water to canals, the drainage of low-lying land, and the removal of sewage to processing sites. To install a pump station, a body of water must be excavated to determine a proper location for the station. Further, while servicing a pumping station, the entire pumping system must be turned off, which temporarily halts progress.

As can be seen, there is a need for an improved system for pumping bodies of liquid

SUMMARY OF THE INVENTION

In one aspect of the present invention, a pumping system comprises: an elongated tubing comprising a first end comprising an entrance to the elongated tubing, a second end comprising an exit from the elongated tubing, and a flange at least partially surrounding the exit; a pump discharge tubing disposed within the elongated tubing and running from the first end to the second end; a pump coupled to the pump discharge tubing and operable to pump a liquid through the pump discharge tubing; and a seal plate comprising an opening sized to snuggly fit the pump discharge tubing within, wherein the seal plate is releasably secured to the flange.

These and other features, aspects and advantages of the present invention will become better understood with reference to the following drawings, description and claims.

DETAILED DESCRIPTION OF THE INVENTION

Figure 1:
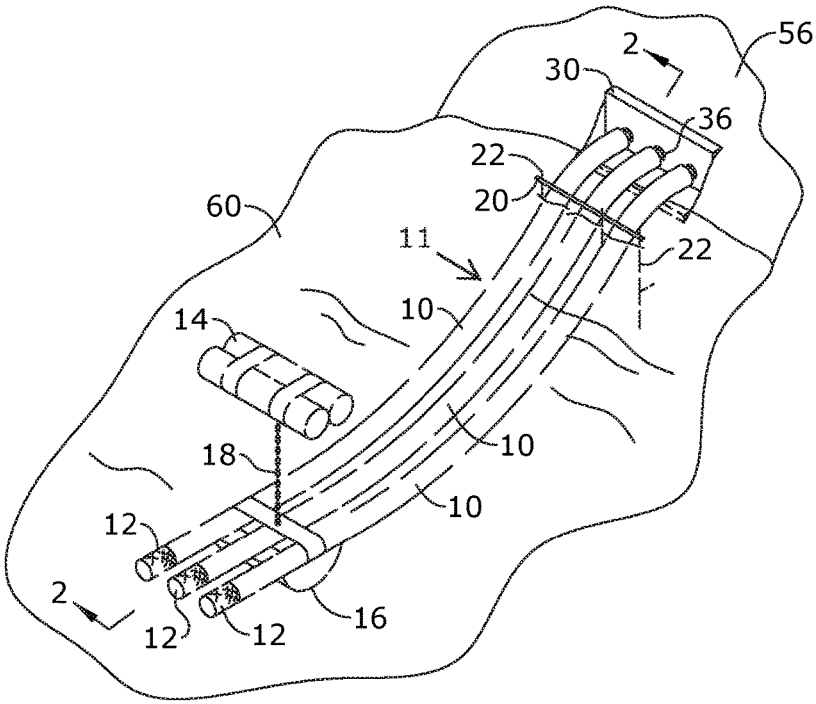
FIG. 1 is a perspective view of an exemplary embodiment of the present invention shown in use.
Figure 2:
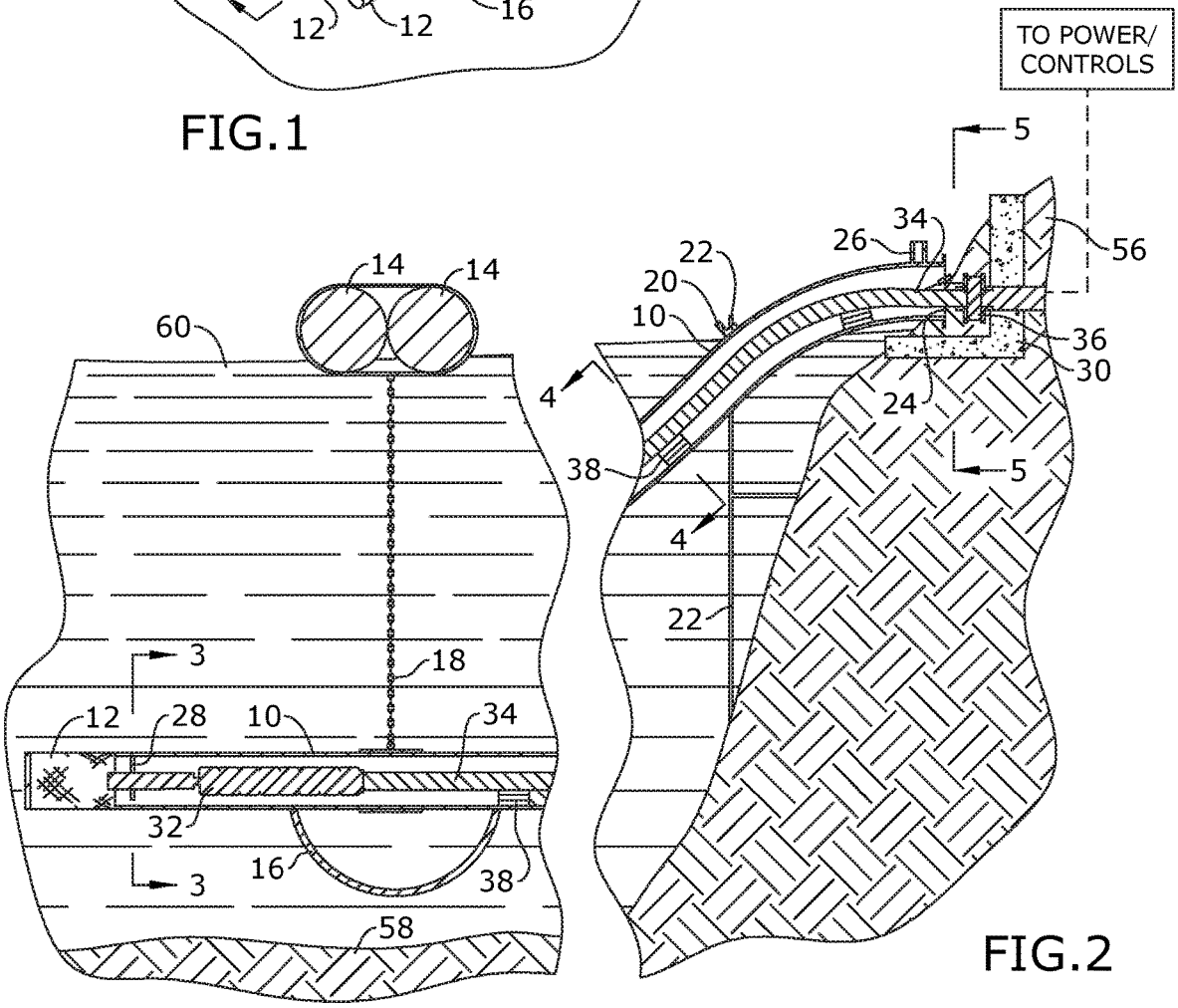
FIG. 2 is a section view of the present invention taken along line 2-2 in FIG. 1 with the pump simplified for clarity.
Figure 3:
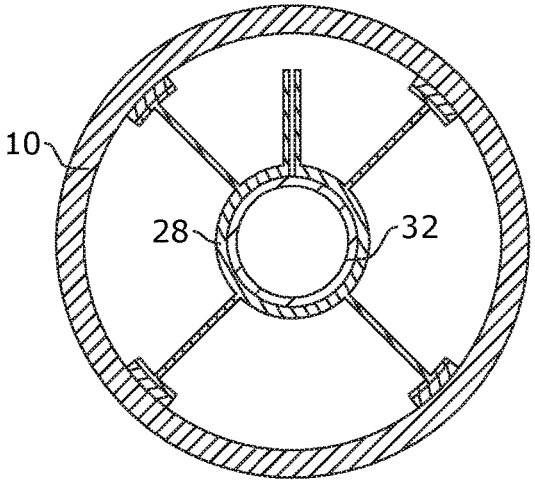
FIG. 3 is a section view of the present invention taken along line 3-3 in FIG. 2.
Figure 4:
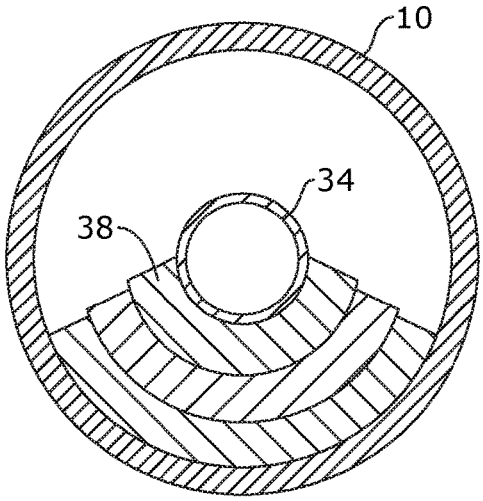
FIG. 4 is a section view of the present invention taken along line 4-4 in FIG. 2.
Figure 5:
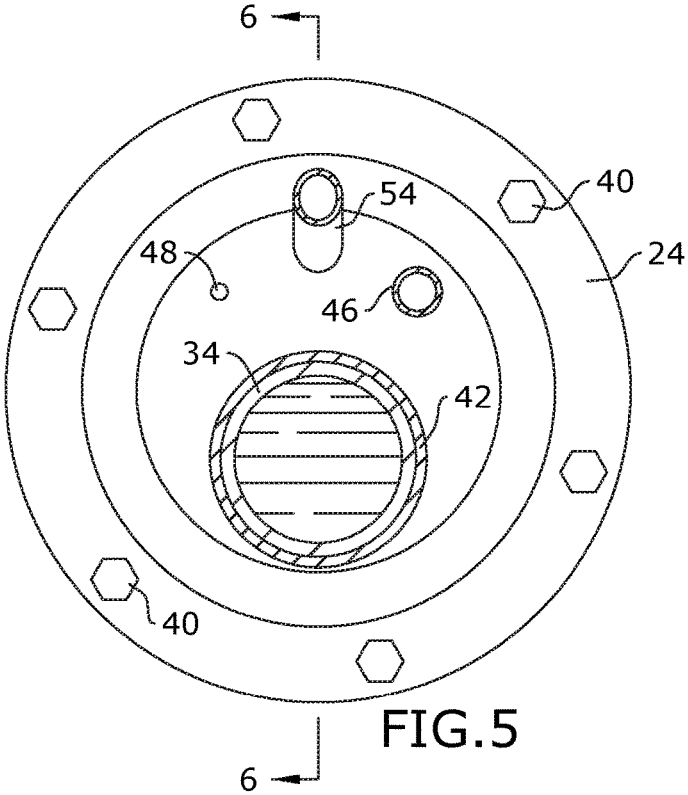
FIG. 5 is a section view of the present invention taken along line 5-5 in FIG. 2.
Figure 6:
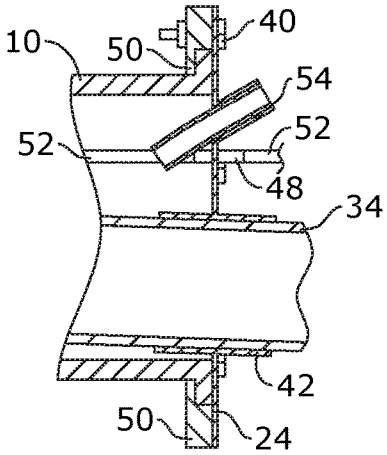
FIG. 6 is a section view of the present invention taken along line 6-6 in FIG. 5.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a pumping system having a plurality of polymer tubes, each having pumps installed within. Each tube may include an end that is located at the water's edge and each pump may be serviced individually while the other pumps are operating. Further, the present invention eliminates the need to excavate the body of water to install a pumping station. To service the pump of the present invention, a flange which is connected to a discharge manifold is taken apart and the pump tube and connection flange are lifted above ground level. The seal plate which is at the end and behind the manifold connection flange is loosened and the pump may be removed for servicing.

Referring to FIGS. 1 through 6, the present invention includes a pumping system. The pumping system includes a plurality of pump tubes 11. Each of the pump tubes 11 include an elongated tubing 10. The elongated tubing 10 may be made of a polymer, such as polyethylene. The elongated tubing 10 includes a first end forming an entrance and a second end forming an exit. A pump discharge tubing 34 is disposed within the elongated tubing 10 and runs from the first end to the second end of the elongated tubing 10. A pump 32 is coupled to the pump discharge tubing 34 and is operable to pump liquids through the pump discharge tubing 34. The pump 32 may be located near the entrance of the elongated tubing 10. A seal plate 24 is releasably secured to a flange 50 formed at the exit of the elongated tubing 10. The pump discharge tubing 34 snuggly runs through an opening 42 formed through the seal plate 24 and releasably secures to a manifold 36.

In certain embodiments, the pumping system of the present invention includes a head wall 30. The head wall 30 may be a concrete structure that is built into a bank 56 of a body of water 60. The head wall 30 may include a plurality of manifolds 36. In such embodiments, the present invention may include a plurality of elongated tubing 10 each including the pump discharge tubing 34, the pump 32 and the seal plate 24. Each of the pump discharge tubing 34 is releasably secured to one of the plurality of manifolds 36. When one of the pumps 32 is in need of repair, the seal plate 24 may be removed from the flange 50 and the pump 32 may be repaired without disturbing the other pumps 32.

The seal plate 24 of the present invention may be made of a metal and may cap the exit of the elongated tubing 10. In certain embodiments, the seal plate 24 may include a small coupling 48 and a large coupling 46. The small coupling 48 may secure prove wiring within and the large coupling 46 may secure power wiring 52 within. The wiring 52 may run through their respective couplings 46, 48 and are connected to the pump 32, thereby powering the pump 32. A flush port 54 may also run through the seal plate 24, allowing backwash of the inlet screen or filter 12. A flush tap 26 may be secured to elongated tubing 10 near the entrance. In certain embodiments, the seal plate 24 is secured to the flange 50 by bolts 40. However, it is envisioned that other connectors may secure the seal plate 24 to the flange 50, such as, but not limited to, clamps, adhesives and the like.

In certain embodiments, an inlet screen or filter 12 is secured to the entrance of the elongated tubing 10. The filter 12 may prevent excess material from entering and clogging the system. The filter 12 may lead into the pump 32 and the pump discharge tubing 34. The pump 32 and the pump discharge tubing 34 may be centered within the elongated tubing 10 by supports 28, 38. The supports 28, 38 may include a discharge spacer 28 having a ring sized to fit the pump 32 within and a plurality of arms extending radially and abutting an inner surface of the elongated tubing 10. The supports 28, 38 may further include spacers 38. The spacers 38 may be located at different areas along the pump discharge tubing 34 and may include stacked layers supporting the pump discharge tubing 34 in an elevated position relative to a bottom inner surface of the elongated tubing 10.

In certain embodiments, the present invention may include a depth controller and a support. The depth controller may include a chain 18 having a first end and a second end. The first end is coupled to the plurality of elongated tubing 10. A floatation device 14 or a plurality of floatation devices 14 are secured to the second end of the chain 18. The floatation device 14 may provide a floatation to support the elongated tubing 10 above the water bottom 58. To control the depth of the elongated tubing 10, a valve of the floating device 14 may be opened to allow water to enter the floatation device 14 or alternatively the chain 18 may be shortened and lengthened. Further, a skid plate 16 having a semi-circular shape may be secured to a bottom side of the elongated tubing 10, thereby preventing the tubing 10 from hitting the water bottom 58. The depth controller may keep the tubing 10 just under water level and deep enough not to cause a vortex in which the pump 32 is sucking air. The support may include guide rods 22 secured to the water bottom 58 and guide straps 20 securing the elongated tubes 10 to the guide rods 22. The support prevents the tubing 10 from bending due to water current.

Figure 7:
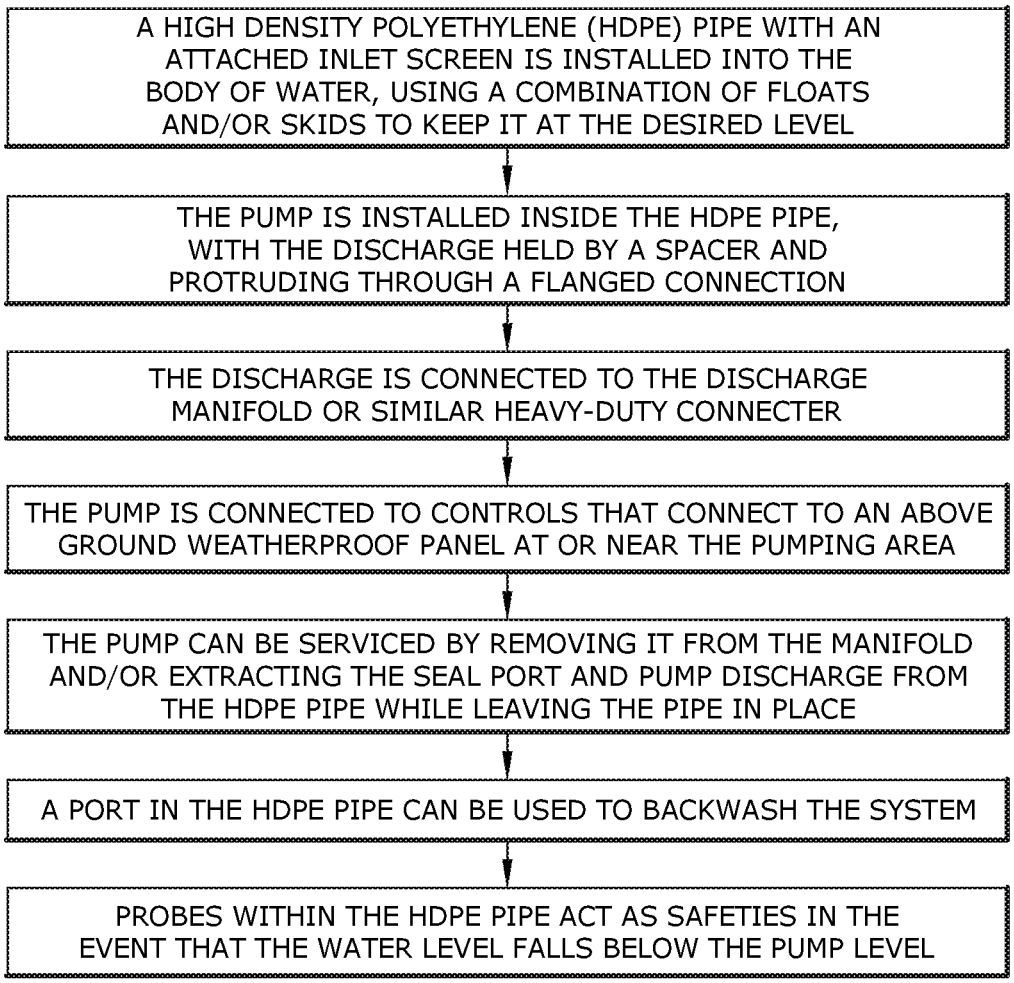
FIG. 7 is a flow chart of an exemplary installation of a single component of the pump tube system.

Referring to FIG. 7, the present invention may include a method of constructing a pumping system. The method includes the following steps: providing a high density polyethylene pipe having an attached inlet screen and installing the pipe into a body of water using floats and/or skids to keep it at a desired level; the pump may be installed inside of the pipe with the discharge held by a spacer and protruding through a flanged connection; the discharge is connected to the discharge manifold or similar heavy duty connector; the pump is connected to controls that connect to an above ground weatherproof panel at or near the pumping area; the pump can be serviced by removing it from the manifold and/or extracting the seal port and pump discharge from the pipe while leaving the other pipes in place; a port in the pipe can be used to backwash the system; and probes within the pipe act as safeties in the event that the water level falls below the pump level.

It should be understood, of course, that the foregoing relates to exemplary embodiments of the invention and that modifications may be made without departing from the spirit and scope of the invention as set forth in the following claims.

What is claimed is:

1. A pumping system comprising:

a head wall disposed above water of a body of water and comprising a plurality of manifolds;

a plurality of pump tubes each comprising:

an elongated tubing comprising a first open end forming an entrance disposed within the water, a second open end forming an exit disposed above the water, and a flange at least partially surrounding the exit;

a pump discharge tubing disposed within the elongated tubing and running from the first open end to the second open end, wherein the pump discharge tubing is releasably secured above the water to a corresponding manifold of the plurality of manifolds of the head wall;

a plurality of supports disposed inside the elongated tube and supporting the pump discharge tubing in an elevated position relative to a bottom inner surface of the elongated tubing;

a pump coupled to the pump discharge tubing and configured to pump the water from the body of water into the first open end of the elongated tubing through the pump discharge tubing and out the second open end of the elongated tubing; and a seal plate comprising an opening, wherein the seal plate is releasably secured to the flange and the pump discharge tubing runs through the opening of the seal plate; and a pump tube support comprising guide straps securing the plurality of pump tubes together and guide rods coupled to the guide straps and configured to secure the pump tubes to a water bottom.

2. The pumping system of claim 1, wherein the seal plate further comprises a small coupling sized to secure a probe wiring within, a large coupling sized to secure a power wiring, and a flush port running through the seal plate.

3. The pumping system of claim 1, wherein the seal plate is releasable secured to the flange by a plurality of bolts.

4. The pumping system of claim 1, wherein each of the plurality of pump tubes further comprise a filter covering the entrance of the elongated tubing.

5. The pumping system of claim 1, further comprising a depth controller comprising:

a chain comprising a first end coupled to the elongated tubing and a second end; and a floatation device secured to the second end.

6. The pumping system of claim 5, wherein the depth controller further comprises a skid plate secured to a bottom side of the elongated tubing, wherein the skid plate is a semi-circular protrusion.

7. The pumping system of claim 1, further comprising a flush tap near the entrance of the elongated tubing.

* * * * *